US010785577B2

(12) United States Patent
Na et al.

(10) Patent No.: US 10,785,577 B2
(45) Date of Patent: Sep. 22, 2020

(54) MEMS MICROPHONE AND METHOD OF MANUFACTURING THE SAME

(71) Applicant: DB HITEK CO., LTD., Seoul (KR)

(72) Inventors: Ye Eun Na, Seoul (KR); Han Choon Lee, Seoul (KR)

(73) Assignee: DB HITEK CO., LTD., Seoul (KR)

( * ) Notice: Subject to any disclaimer, the term of this patent is extended or adjusted under 35 U.S.C. 154(b) by 0 days.

(21) Appl. No.: 16/441,958

(22) Filed: Jun. 14, 2019

(65) Prior Publication Data

US 2019/0387325 A1 Dec. 19, 2019

(30) Foreign Application Priority Data

Jun. 15, 2018 (KR) ..... 10-2018-0068679

(51) Int. Cl.

| | |
|---|---|
| ***H04R 19/04*** | (2006.01) |
| ***H04R 31/00*** | (2006.01) |
| ***H04R 7/04*** | (2006.01) |
| ***H04R 7/18*** | (2006.01) |

(52) U.S. Cl.

CPC ..... *H04R 19/04* (2013.01); *H04R 7/04* (2013.01); *H04R 7/18* (2013.01); *H04R 31/003* (2013.01); *H04R 2201/003* (2013.01)

(58) Field of Classification Search

CPC ..... H04R 7/04; H04R 7/18; H04R 19/005; H04R 19/04; H04R 31/003; H04R 2201/003

See application file for complete search history.

(56) References Cited

U.S. PATENT DOCUMENTS

2010/0065930 A1* 3/2010 Nakatani ..... B81C 1/00476 257/415

2010/0158279 A1* 6/2010 Conti ..... H04R 7/24 381/174

* cited by examiner

*Primary Examiner* — Brian Ensey

(74) *Attorney, Agent, or Firm* — Patterson Thuente Pedersen, P.A.

(57) ABSTRACT

A MEMS microphone includes a substrate having a cavity, a back plate disposed over the substrate, a diaphragm disposed between the substrate and the back plate, a first supporting member surrounding the diaphragm, the first supporting member including first dam portions arranged along a circumference of the diaphragm, and first slit portions between the first dam portion adjacent to each other to be configured to support the diaphragm from a lower face of the substrate, and a second supporting member surrounding the first supporting member, the second supporting member including second dam portions arranged along a circumference of the first dam portions, and second slit portions between the second dam portion adjacent to each other to be configured to further support the diaphragm from the lower face of the substrate. Thus, the MEMS microphone has an increased acoustic resistance.

18 Claims, 10 Drawing Sheets

MEMS MICROPHONE AND METHOD OF MANUFACTURING THE SAME

CROSS-REFERENCE TO RELATED APPLICATION

This application claims priority to Korean Patent Application No. 10-2018-0068679, filed on Jun. 15, 2018, and all the benefits accruing therefrom under 35 U.S.C. § 119, the contents of which are incorporated by reference in their entirety.

TECHNICAL FIELD

The present disclosure relates to a Micro Electro Mechanical Systems (MEMS) microphone capable of converting an acoustic wave into an electrical signal and a method of manufacturing the same. More particularly, the present disclosure relates to a capacitive MEMS microphone being capable of transforming the acoustic wave into the electric signal using a displacement of a diaphragm which occurs due to an acoustic pressure, and a method of manufacturing such a MEMS microphone.

BACKGROUND

Generally, a capacitive microphone utilizes a capacitance measured between a pair of electrodes which are facing each other to detect an acoustic wave to output an electrical signal. The capacitive microphone may be manufactured through semiconductor MEMS processes to achieve a MEMS microphone having an ultra-small size.

The capacitive microphone includes a diaphragm being configured to be bendable and a back plate facing the diaphragm such that an air gap is defined between the diaphragm and the back plate. The diaphragm may have a membrane structure to perceive an acoustic pressure to generate a displacement. In particular, when the acoustic pressure is applied to the diaphragm, the diaphragm may be bent toward the back plate due to the acoustic pressure. The displacement of the diaphragm may be perceived through a value change of capacitance defined between the diaphragm and the back plate. As a result, an acoustic wave may be converted into an electrical signal such that the electrical signal may be outputted.

The MEMS microphone has various characteristics such as a frequency resonance, a pull-in voltage, a Total Harmonic Distortion (hereinafter, referred as "THD"), a sensitivity, etc.

In particular, when the MEMS microphone is applied to a high-end mobile device, it may be required for the MEMS microphone to have improved acoustic resistance. In order to improve the acoustic resistance, it may be required to increase the acoustic resistance of air when discharged from the air gap.

SUMMARY

The example embodiments of the present invention provide a MEMS microphone capable of having an improved acoustic resistance.

The example embodiments of the present invention provide a method of manufacturing a MEMS microphone capable of having an improved acoustic resistance.

According to some example embodiments of the present invention, a MEMS microphone includes a substrate having a cavity, a back plate disposed over the substrate and having a plurality of acoustic holes, a diaphragm disposed between the substrate and the back plate, the diaphragm being spaced apart from the substrate, being apart form the back plate to form an air gap between the diaphragm and the back plate, and covering the cavity, the diaphragm being configured to sense an acoustic pressure to generate a displacement, a first supporting member surrounding the diaphragm, the first supporting member including first dam portions arranged along a circumference of the diaphragm, and first slit portions between the first dam portion adjacent to each other to be configured to support the diaphragm from a lower face of the substrate, and a second supporting member surrounding the first supporting member, the second supporting member including second dam portions arranged along a circumference of the first dam portions, and second slit portions between the second dam portion adjacent to each other to be configured to further support the diaphragm from the lower face of the substrate.

In an example embodiment, the first and the second supporting members may be concentrically arranged.

In an example embodiment, the first and the second slit portions may be alternatively arranged in a plan view.

In an example embodiment, each of the first slit portions has a length smaller than that of each of the first portions.

In an example embodiment, each of the second slit portions has a length smaller than that of each of second dam portions.

In an example embodiment, each of the first dam portions has an arc shape in a plane view.

In an example embodiment, each of the second dam portions has an arc shape in a plane view.

In an example embodiment, each of the first dam portions has a "U" sectional shape.

In an example embodiment, each of the second dam portions has a "U" sectional shape.

In an example embodiment, the first and the second supporting members may be integrally formed with the diaphragm.

In an example embodiment, the MEMS microphone may further comprises an upper insulation layer disposed over the diaphragm and spaced apart from the diaphragm, the upper insulation layer being configured to hold the back plate, and a chamber portion positioned outside from the second supporting member, the chamber portion being connected to the upper insulation layer and making contact with the lower face of the substrate to support the upper insulation layer.

According to some example embodiments of the present invention, a lower insulation layer is formed on a substrate defining a vibration area, a supporting area surrounding the vibration area, and a peripheral area surrounding the supporting area, a diaphragm and first and second dam portions of supporting the diaphragm are formed on the lower insulation layer, a sacrificial layer is formed on the lower insulation layer to cover the diaphragm, a back plate is formed on the sacrificial layer and in the vibration area to face the diaphragm, the back plate is patterned to form a plurality of acoustic holes penetrating through the back plate, the substrate is patterned to form a cavity to partially expose the lower insulation layer in the vibration region, and an etch process is performed using the cavity and the acoustic holes to remove portions of the lower insulation layer and the sacrificial layer in the vibration area and the supporting area, wherein performing the etch process using the cavity and the acoustic holes includes forming first slit portions between the first dam portions adjacent to each other to form a first supporting member including the first dam portions and the first slit portions and forming the second slit portions between the second dam portions adjacent to each other to form a second supporting member including the second dam portions and the second slit portions.

In an example embodiment, forming the diaphragm and the first and second dam portions may include patterning the lower insulation layer to form a plurality of first dam holes spaced apart from each other and a plurality of second dam holes surrounding the first dam holes and being spaced from each other for forming the first and second dam portions, forming a silicon layer on the lower insulation layer to cover the first and second dam holes, and patterning the silicon layer to form the diaphragm and the first and second dam portions.

In an example embodiment, prior to forming the acoustic holes, the sacrificial layer and the lower insulation layer may be patterned to form a chamber hole in the supporting area, an insulation layer for holding the back plate may be formed on the sacrificial layer to cover the back plate and the chamber hole, and the insulation layer may be formed to form the upper insulation layer for holding the back plate, and a chamber portion in the chamber hole, wherein forming the acoustic holes may include patterning the back plate and the upper insulation layer to form the acoustic holes penetrating through the back plate and the upper insulation layer in the vibration region.

In an example embodiment, wherein the first and the second supporting members may be concentrically arranged.

In an example embodiment, the first and the second slit portions may be alternatively arranged in a plan view.

In an example embodiment, each of the first slit portions may have a length smaller than that of each of the first portions.

In an example embodiment, each of the second slit portions may have a length smaller than that of each of second dam portions.

According to example embodiments of the present invention as described above, the MEMS microphone includes the first supporting member and the second supporting member extending along the circumference of the diaphragm. Further the areas of the first slit portions and the second slit portions included in the first and second support members may be adjusted. In particular, since the first and second slit portions serve as a pathway through which the acoustic pressure flows, the MEMS microphone may reduce the area of the effective pathway where the acoustic pressure flows. As a result, the MEMS microphone may have increased acoustic resistance. Therefore, the MEMS microphone has a low pass filter effect to weaken the noise component at high frequencies. As a result, the MEMS microphone may have improved SNR characteristics.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Exemplary embodiments can be understood in more detail from the following description taken in conjunction with the accompanying drawings, in which.

Figure 1:
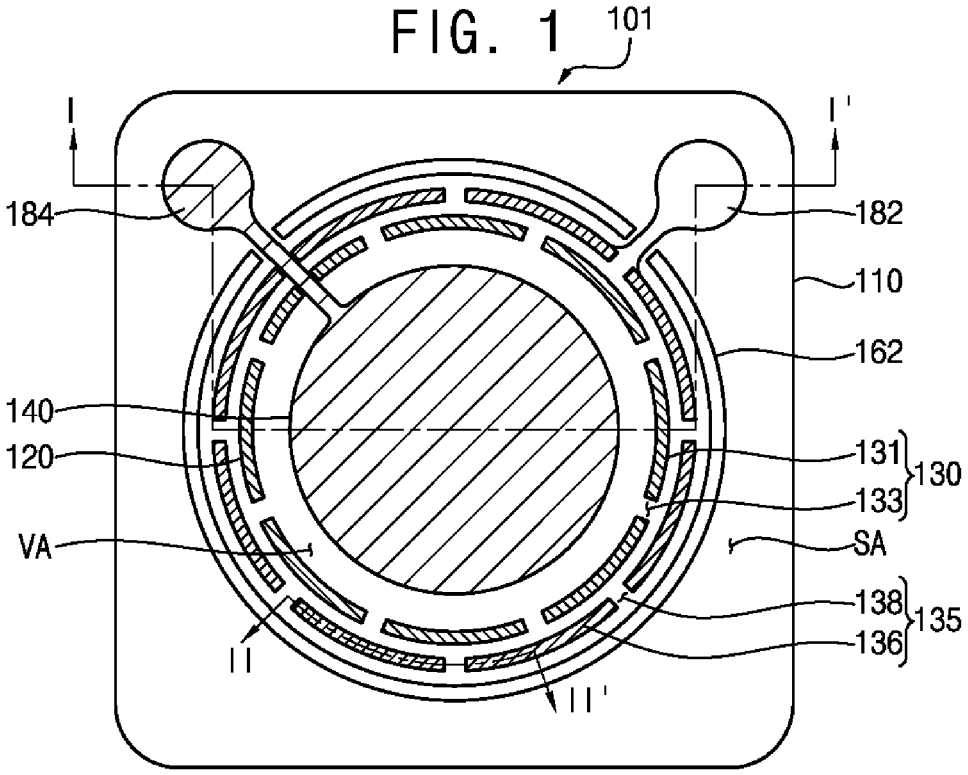
FIG. 1 is a plan view illustrating a MEMS microphone in accordance with an embodiment of the present invention.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims

DETAILED DESCRIPTION OF EMBODIMENTS

Hereinafter, specific embodiments will be described in more detail with reference to the accompanying drawings. The present invention may, however, be embodied in different forms and should not be construed as limited to the embodiments set forth herein.

As an explicit definition used in this application, when a layer, a film, a region or a plate is referred to as being 'on' another one, it can be directly on the other one, or one or more intervening layers, films, regions or plates may also be present. Unlike this, it will also be understood that when a layer, a film, a region or a plate is referred to as being 'directly on' another one, it is directly on the other one, and one or more intervening layers, films, regions or plates do not exist. Also, though terms like a first, a second, and a third are used to describe various components, compositions, regions and layers in various embodiments of the present invention are not limited to these terms.

Furthermore, and solely for convenience of description, elements may be referred to as "above" or "below" one another. It will be understood that such description refers to the orientation shown in the Figure being described, and that in various uses and alternative embodiments these elements could be rotated or transposed in alternative arrangements and configurations.

In the following description, the technical terms are used only for explaining specific embodiments while not limiting the scope of the present invention. Unless otherwise defined herein, all the terms used herein, which include technical or scientific terms, may have the same meaning that is generally understood by those skilled in the art.

The depicted embodiments are described with reference to schematic diagrams of some embodiments of the present invention. Accordingly, changes in the shapes of the diagrams, for example, changes in manufacturing techniques and/or allowable errors, are sufficiently expected. Accordingly, embodiments of the present invention are not described as being limited to specific shapes of areas described with diagrams and include deviations in the shapes and also the areas described with drawings are entirely schematic and their shapes do not represent accurate shapes and also do not limit the scope of the present invention.

FIG. 1 is a plan view illustrating a MEMS microphone in accordance with an embodiment of the present invention.

Figure 2:
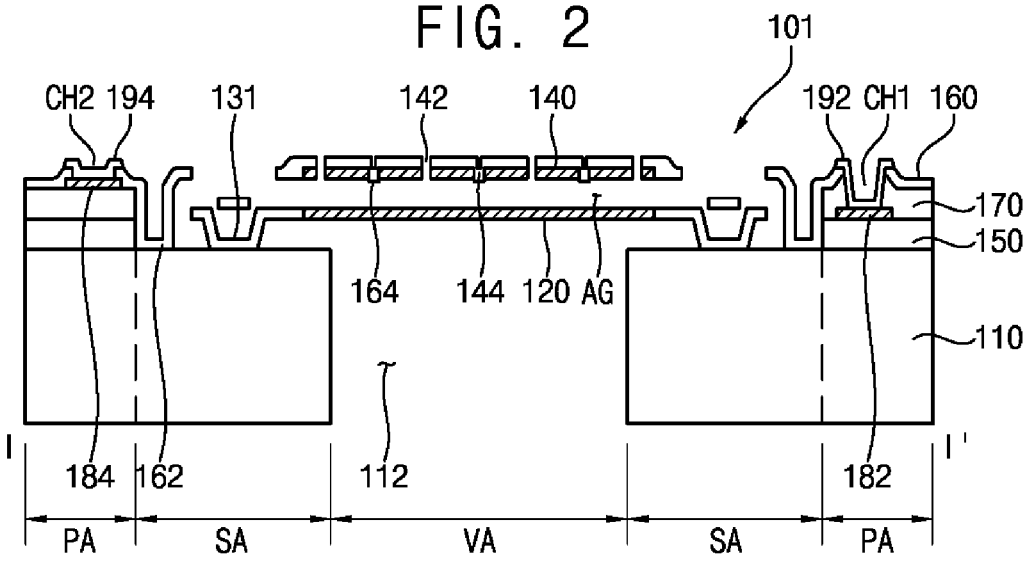
FIG. 2 is a cross sectional view taken along a line I-I' in FIG. 1.
Figure 3:
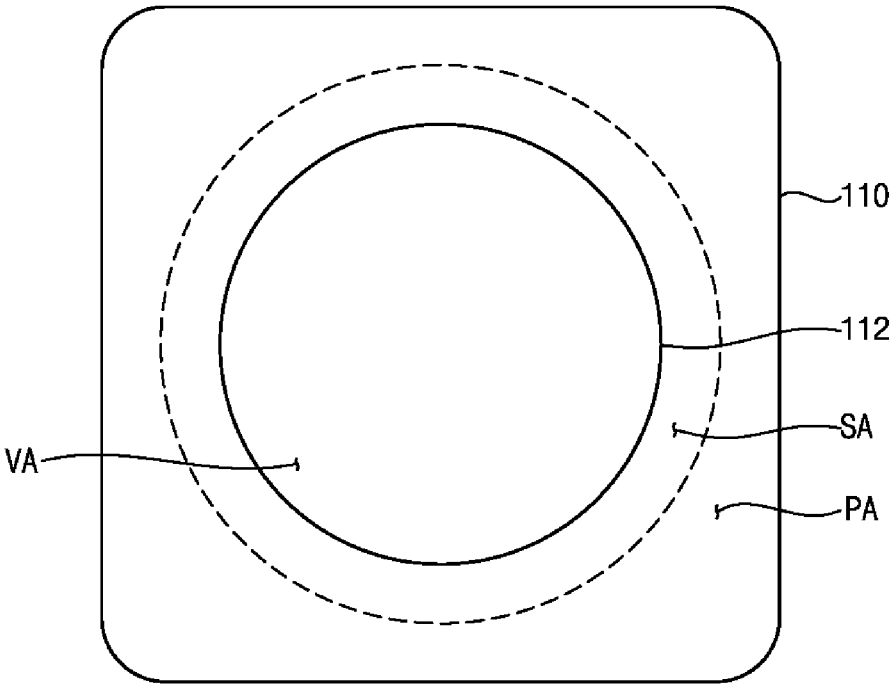
FIG. 3 is a plan view illustrating the substrate in FIG. 1.
Figure 4:
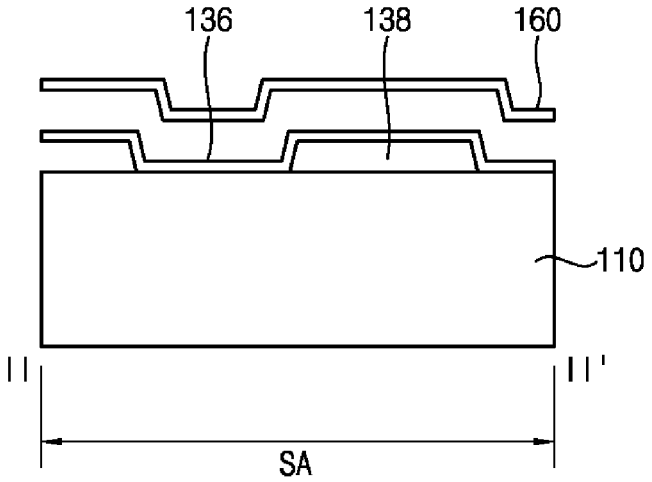
FIG. 4 is a cross sectional view taken along a line II-II' in FIG. 1.

FIG. 2 is a cross sectional view taken along a line I-I' in FIG. 1. FIG. 3 is a plan view illustrating the substrate in FIG. 1. FIG. 4 is a cross sectional view taken along a line II-II' in FIG. 1.

Referring to FIGS. 1 to 4, a MEMS microphone 101 in accordance with an example embodiment of the present invention includes a substrate 110, a diaphragm 120, a back plate 140, a first supporting member 130 and a second supporting member 135.

As shown in FIG. 3, the substrate 110 is divided into a vibration area VA, a supporting area SA surrounding the vibration area VA, and a peripheral area PA surrounding the supporting area SA. In the vibration area VA, a cavity 112 is formed. The cavity 112 may penetrate through the substrate 110 in a vertical direction.

The cavity 112 may provide a space in order for the diaphragm 120 to be downwardly bendable (i.e., bendable into the cavity 112) when an acoustic pressure is applied. Further, the cavity 112 may serve as a moving path of the applied acoustic pressure wave.

In an example embodiment, the cavity 112 may have a cylindrical column shape. The cavity 112 may have a planar size corresponding to that of the vibration area VA.

The diaphragm 120 may be positioned over the substrate 110. The diaphragm 120 may have a membrane structure. The diaphragm 120 detects the acoustic pressure to generate a displacement.

The diaphragm 120 is disposed to cover the cavity 112. Further, the diaphragm 120 is positioned to correspond to the vibration area VA. The diaphragm 120 may have a lower face exposed through the cavity 112. The diaphragm 120 is spaced apart from the substrate 110 to be configured to be downwardly bendable with responding to the acoustic pressure.

As shown in FIG. 2, the diaphragm 120 may have an ion implantation region into which impurities such III element or V elements are doped. The ion implantation region may face the back plate 140.

In an example embodiment, the diaphragm 120 may have a shape of a disc plate, as shown in FIG. 1.

The back plate 140 may be disposed over the diaphragm 120. The back plate 140 may be positioned in the vibration area VA. The back plate 140 is spaced apart from the diaphragm 120 and is provided to face the diaphragm 120. Like the diaphragm 120, the back plate 140 may have a disc shape. The back plate 140 may be doped with impurities by implanting the impurities through an ion-implanting process.

The first supporting member 130 is disposed in the supporting area SA. The first supporting member 130 is adjacent to a peripheral portion of the diaphragm 120 to be arranged along the peripheral portion of the diaphragm 120. The first supporting member 130 includes a plurality of first dam portions 131 arranged along the peripheral portion and connected to the diaphragm 120, and a plurality of first slit portions 133 defined by the first dam portions 131 adjacent to each other. The first dam portions 131 are arranged along the peripheral portion of the diaphragm 120 and are apart from one another. The first dam portions 131 are also arranged to surround the cavity 112.

Each of the first dam portions 131 has a dam shape, that is, a "U" cross-sectional shape as best shown in FIG. 2. The first dam portions 131 make contact with the lower face of the substrate 110. Thus, the first supporting member 130 may support the diaphragm 120 with respect to the substrate 110 from which the diaphragm 120 is spaced apart.

The first slit portions 133 are defined by two first dam portions 131 adjacent to each other. Thus, air may flow through the first slit portions 133.

The first slit portions 133 may serve as a fluid pathway through which a wave of the acoustic pressure flows. As shown in FIG. 1, each of the first slit portions 133 may have a length smaller than that of each of the first dam portions 131. Thus, each of the first dam portions 131 may have a planar area larger than that of each of the first slit portions 133. In particular, a total area of the first slit portions 133 disposed between the first dam portions 131 adjacent to each other may depend on a number of the first slit portions 133. Thus, the smaller the number of the first slit portions 133, the smaller the total area of the first slit portions 133.

The second supporting member 135 is disposed in the supporting area SA. The second supporting member 135 surrounds the first supporting member 130. The second supporting member 135 includes a plurality of second dam portions 136 arranged along the first dam portions 131 and a plurality of second slit portions 138 defined by the second dam portions 136 adjacent to each other.

Each of the second dam portions 136 has a dam shape, that is, a "U" sectional shape. The second dam portions 136 make contact with the lower face of the substrate 110. Thus, the second supporting member 135 may further support the diaphragm 120 together with the first supporting member 130 with respect to the substrate 110 from which the diaphragm 120 is spaced apart.

The second slit portions 138 are defined by two second dam portions 136 adjacent to each other. Thus, air may flow through the second slit portions 138.

The second slit portions 138 may serve as a pathway through with the acoustic pressure flows. As shown in FIG. 1, each of the second slit portions 138 may have a length smaller than that of each of the dam portions 136. Thus, each of the second dam portions 136 may have a planar area larger than that of each of the second slit portions 138. In particular, a total area of the second slit portions 138 disposed between the second dam portions 136 adjacent to each other may depend on a number of the second slit portions 138. Thus, the smaller the number of the second slit portions 138, the smaller the total area of the second slit portions 138.

Since the second supporting member 135 including the second dam portions 136 and the second slit portions 138 is further disposed on the substrate 110, a pathway through which a wave of acoustic pressure flows may be elongated. Thus, an acoustic resistance of the acoustic pressure which flows through the first and second supporting members 130 and 135 may be increased.

Accordingly, the MEMS microphone 101 has a low pass filter effect, which may weakens a noise component in a high frequency range. As a result, the MEMS microphone 101 may have an excellent Signal-to-Noise Ratio (SNR).

In some example embodiments, the MEMS microphone 101 may further include an upper insulation layer 160 and a chamber portion 162.

The upper insulation layer 160 may be disposed over the substrate 110. The upper insulation layer 160 may cover a top surface of the back plate 140. The upper insulation layer 160 may hold the back plate 140 and may be connected with the chamber portion 162 to space the back plate 140 apart from the diaphragm 120.

As show in FIG. 2, the upper insulation layer 160 is spaced apart from the diaphragm 120 to form the air gap AG between the diaphragm 120 and the back plate 140.

The back plate 140 and the upper insulation layer 160 may be provided to be freely bendable with response to the acoustic pressure.

A plurality of acoustic holes 142 is formed through the back plate 140 such that acoustic pressure passes through the acoustic holes 142. The acoustic holes 142 penetrate through the back plate 140 and the upper insulation layer 160 to communicate with the air gap AG.

In an embodiment, the back plate 140 may have a plurality of dimple holes 144, and the upper insulation layer 160 may have a plurality of dimples 164 positioned to correspond to those of the dimple holes 144. The dimple holes 144 penetrate through the back plate 140, and the dimples 164 are provided at positions where the dimple holes 144 are formed.

The dimples 164 may prevent the diaphragm 120 from being coupled to a lower face of the back plate 140. That is, when the sound reaches to the diaphragm 120, the diaphragm 120 can be bent in a semicircular shape toward the back plate 140, and then can return to its initial position. A bending degree of the diaphragm 120 may vary depending on the sound pressure and may be increased to such an extent that an upper face of the diaphragm 120 makes contact with the lower face of the back plate 140. When the diaphragm 120 is bent so much as to contact the back plate 140, the diaphragm 120 may attach to the back plate 140 and may not return to the initial position. In order to prevent the diaphragm 120 from permanently attaching to the back plate 140, the dimple 164 may protrude from a lower face of the back plate 140 toward the diaphragm 120. When the diaphragm 120 is bent so much as to contact the back plate 140, the dimples 164 make contact with the diaphragm 120 and prevent the diaphragm 120 from sticking along its entire surface, so that the diaphragm 120 can to return to the initial position.

The chamber portion 162 may be positioned at a boundary region between the supporting area SA and the peripheral region PA. The chamber portion 162 may support the upper insulation layer 160 to maintain the upper insulation layer 160 and the back plate 140 to be apart from the diaphragm 120. As shown FIG. 1, the chamber portion 162 may have a ring shape to surround the diaphragm 120. The chamber portion 162 may be positioned to be apart from the diaphragm 120 and the second supporting member 135 in a plan view.

The chamber portion 162 may extend from an edge portion of the upper insulation layer 160 toward the substrate 110. The chamber portion 162 has a lower face making contact with the lower face of the substrate 110.

In an embodiment, the chamber portion 162 may have a cross-section of a "U" shape, as shown in FIG. 2. The chamber portion 162 may be integrally formed with the upper insulation layer 160.

As shown in FIG. 2, the chamber portion 162 may be spaced apart from the diaphragm 120 and may be positioned outside from the second supporting member 135. As shown in FIG. 1, the chamber portion 162 may have a ring shape.

In an example embodiment, the MEM microphone 101 may further include a lower insulation layer 150, a sacrificial layer 170, a diaphragm pad 182, a back plate pad 184, a first pad electrode 192 and a second pad electrode 194.

In particular, the lower insulation layer 150 may be disposed on the upper surface of the substrate 110 and under the upper insulation layer 160

The diaphragm pad 182 may be disposed on the upper face of the lower insulation layer 150 and in the peripheral area PA. The diaphragm pad 182 may be electrically connected to the diaphragm 120. The diaphragm pad 182 may be doped with impurities by an ion-implanting process. Even though not shown in detail, a connection porting of connecting the diaphragm 120 with the diaphragm pad 182 may be doped with impurities as well.

The sacrificial layer 170 may be disposed on the lower insulation layer 150 to cover the diaphragm pad 182. Further, the sacrificial layer 170 is disposed beneath the upper insulation layer 160. As shown in FIG. 2, the lower insulation layer 150 and the sacrificial layer 170 are located in the peripheral area PA. Here, the lower insulation layer 150 and the sacrificial layer 170 may be located outside from the chamber portion 162 in a plan view. Further, the lower insulation layer 150 and the sacrificial layer 170 may be formed using materials different from each other.

The back plate pad 184 may be formed on an upper face of the sacrificial layer 170 and in the peripheral area PA. The back plate pad 184 is electrically connected to the back plate 140 and may be formed with impurities by an ion implanting process. Even though not shown in detail, a connection porting of connecting the back plate 140 with the back plate pad 184 may be doped with impurities as well.

The first and second pad electrodes 192 and 194 may be formed on the upper insulation layer 160 and in the peripheral area PA. The first pad electrode 192 is located in a first contact hole CH1 to make contact with the diaphragm pad 182. On the other hand, the second pad electrode 194 is located in a second contact hole CH2 and makes contact with the back plate pad 184. Here, the first and second pad electrodes 192 and 194 may be transparent electrodes. As shown in FIG. 2, the diaphragm pad 182 is exposed through the first contact hole CH1 formed by partially removing the second insulation layer 160 and the insulating interlayer 170. The back plate pad 184 is exposed through the second contact hole CH2 formed by partially removing the second insulation layer 160.

According to some example embodiment, the MEMS microphone 101 includes the first supporting member 130 and the second supporting member 135 which surround the diaphragm 120, and the first and the second supporting members 130 and 135 include the first and the second slit portions 133 and 138 having variable area, respectively. In particular, since the first and the second slit portions 133 and 138 may serve as pathways through which acoustic pressure may flow, the MEMS microphone 101 has less outlet area for the acoustic pressure to escape the cavity 112, such that the MEMS microphone 101 has an increased acoustic resistance. Thus, since the MEMS microphone 101 has a low pass filter effect, the noise component may be weakened while the acoustic pressure having a relatively high frequency is applied. As a result, the MEMS microphone 101 may have improved SNR characteristics In an example embodiment of the present invention, the first and second supporting members 130 and 135 are concentrically arranged. That is, the first and second supporting members 130 and 135 may be arranged along an arc with respect to a center of the cavity 112, respectively.

In an example embodiment of the present invention, the first and second slit portions 133 and 138 may be alternately arranged in a plan view. That is, the first and second slit portions 133 and 138 may not be aligned along radial lines extending outwardly from the center of the device 101. Therefore, as the resistance of the air discharged from the air gap AG increases, the acoustic pressure resistance of the MEMS microphone 101 may be increased.

Hereinafter, a method of manufacturing a MEMS microphone 101 will be described in detail with reference to the drawings.

Figure 5:
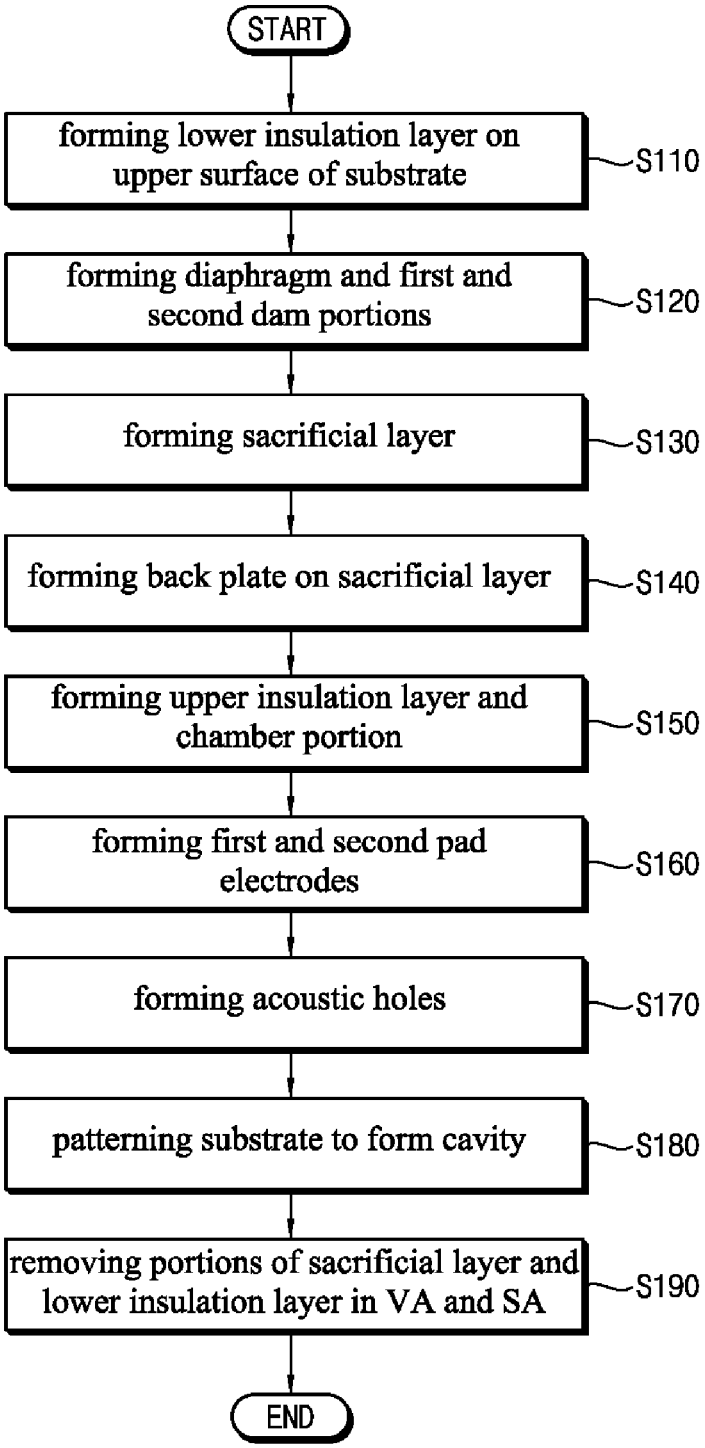
FIG. 5 is a flow chart illustrating a method of manufacturing a MEMS microphone in accordance with an embodiment of the present invention.
Figure 6:
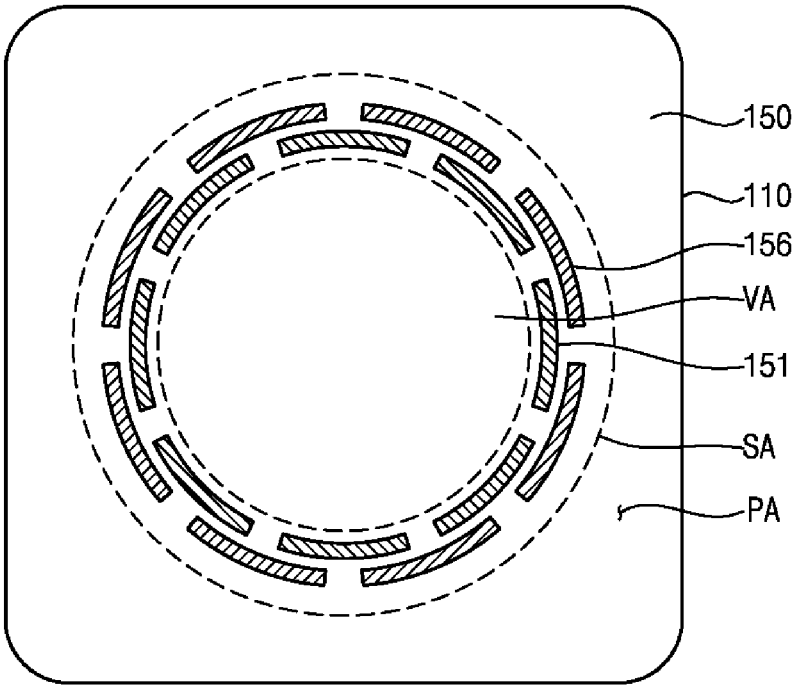
FIG. 6 is a plan view illustrating the lower insulation layer having the first and the second dam holes.

FIG. 5 is a flow chart illustrating a method of manufacturing a MEMS microphone in accordance with an example embodiment of the present invention. FIG. 6 is a plan view illustrating the lower insulation layer 150 having the first and the second dam holes (151 and 156, respectively). FIGS. 7 to 17 are cross sectional views illustrating a method of manufacturing a MEMS microphone in accordance with an example embodiment of the present invention.

Referring to FIGS. 5 to 9 according to an example embodiment of a method for manufacturing a MEMS microphone, a lower insulation layer 150 is formed on a substrate 110 (S110).

Next, first dam portions 131 and second dam portions 136 are formed on the lower insulation layer 150 (S120).

Forming the first and the second dam portions 131 and 136 will be explained in detail as below.

Figure 7:
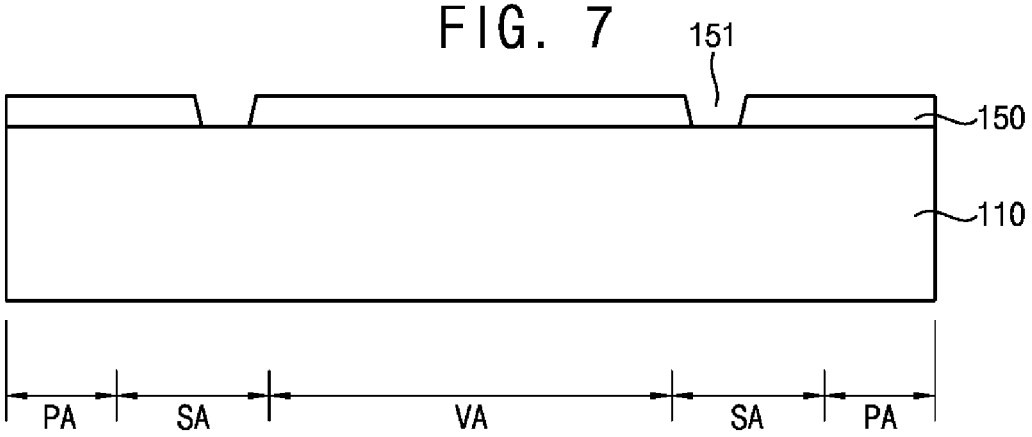
FIGS. 7 to 17 are cross sectional views illustrating a method of manufacturing a MEMS microphone in accordance with an embodiment of the present invention.

As shown in FIGS. 6 and 7, the lower insulation layer 150 is patterned to form first dam holes 151 and second dam holes 156 in a supporting area SA for forming the first and the second supporting members 130 and 135. The substrate 110 may be partially exposed through the first and the second dam holes 151 and 156. As shown in FIG. 7, the first dam holes 151 are arranged to surround a vibration area VA. The first dam holes 151 are arranged along a peripheral edge of the vibration area VA. Further, the second dam holes 156 may be arranged to surround the first dam holes 151 (see FIG. 6). The first and the second dam holes 151 and 156 are disposed in the supporting area SA.

Figure 8:
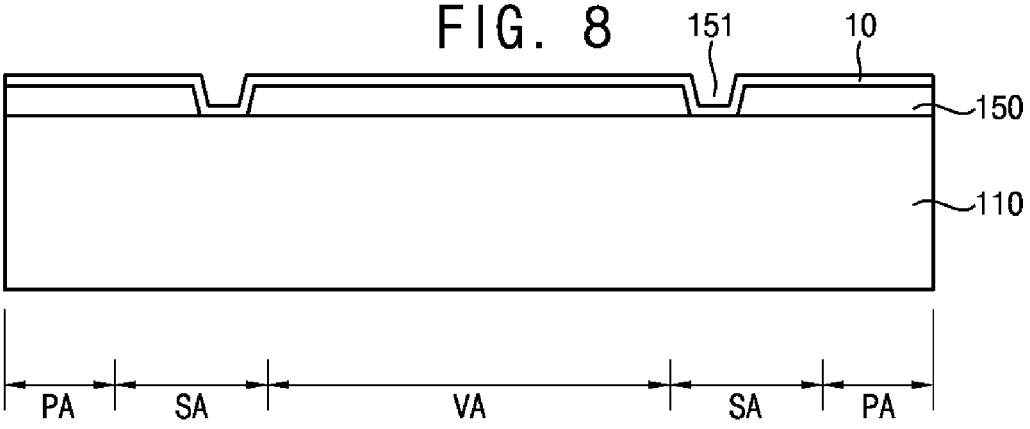

Next, as shown in FIG. 8, a first silicon layer 10 is formed on the lower insulation layer 150 to cover the first and the second dam holes 151 and 156. The first silicon layer 10 may be formed using polysilicon by a chemical vapor deposition process. Further, impurities may be doped into the vibration area VA of the first silicon layer 10 through an ion implanting process for forming a diaphragm 120 having a relatively low resistance in the vibration area VA and a diaphragm pad 182 in the peripheral area PA in a subsequent patterning process.

Figure 9:
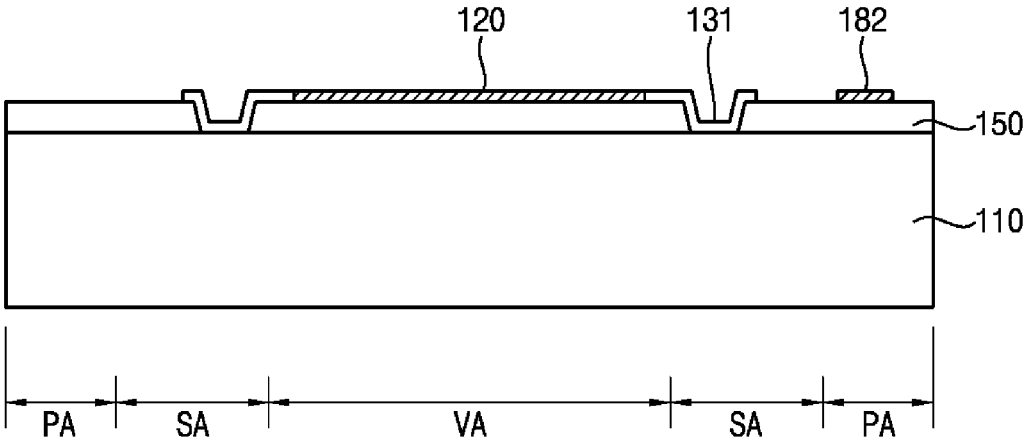

Next, as shown in FIG. 9, the first silicon layer 10 is patterned to form a diaphragm 120 in the vibration area VA, the first and the second dam portions 131 and 136 (see FIGS. 1 and 9) in the supporting area SA, and the diaphragm pad 182 in the peripheral area PA.

Figure 10:
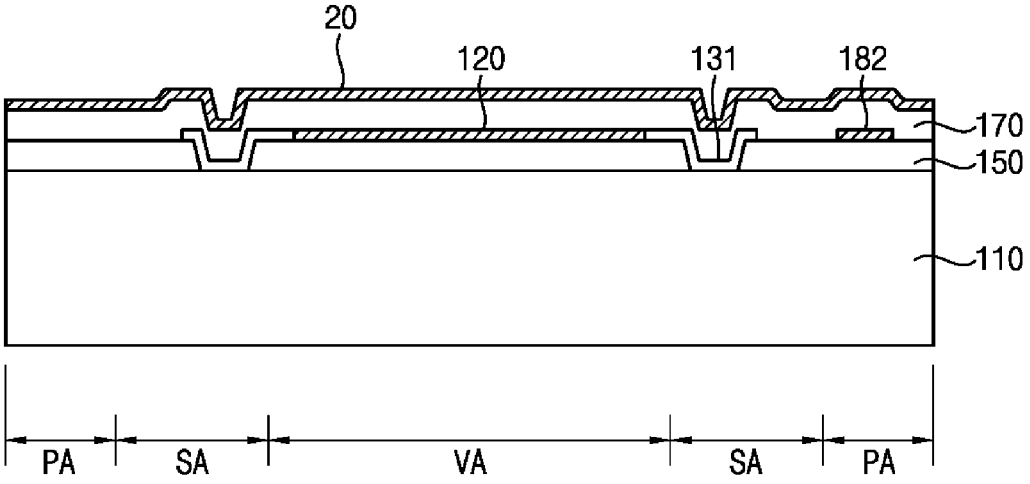

Referring to FIGS. 5 and 10, a sacrificial layer 170 is formed on the lower insulation layer 150 to cover the diaphragm 120 and the diaphragm pad 182 (S130).

Next, a back plate 140 is formed on the sacrificial layer 170 (S140).

At S140, the back plate 140 is formed on the sacrificial layer 170, as will be explained in detail below.

Referring to FIG. 10, a second silicon layer 20 is formed on the sacrificial layer 170 and then, the second silicon layer 20 is doped with impurities by an ion implanting process. Here, the second silicon layer 20 may be formed using polysilicon.

Figure 11:
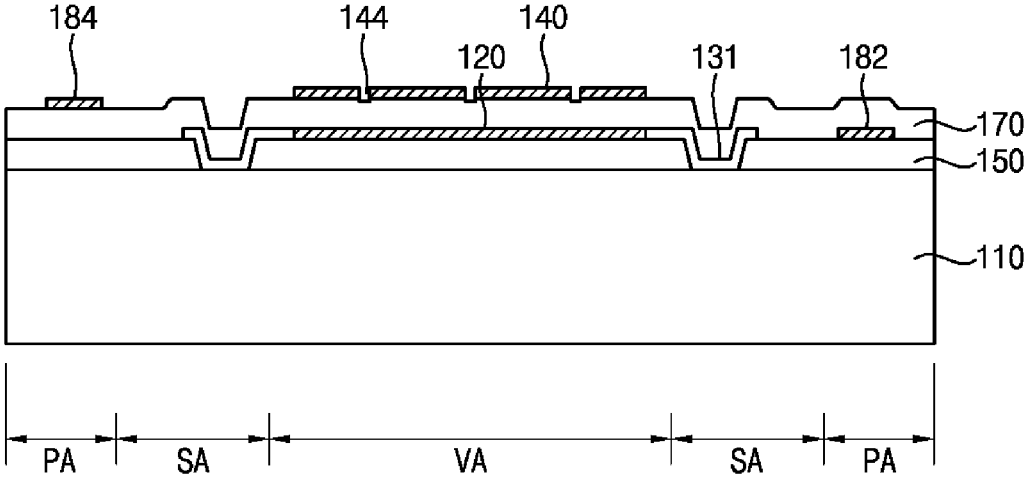

Then, as shown in FIG. 11, the second silicon layer 20 is patterned to form a back plate 140 having dimple holes 144 in the vibration area VA. Further, a portion of the sacrificial layer 170, which correspond to the dimple holes 144, may be further etched such that the dimples 164 protrude from a lower face of the back plate 140 in a subsequent process.

Figure 12:
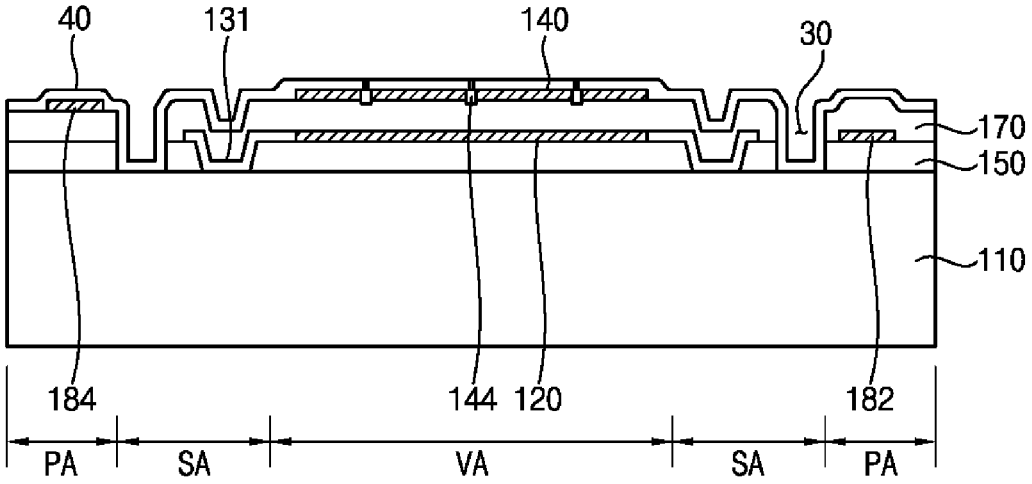
Figure 13:
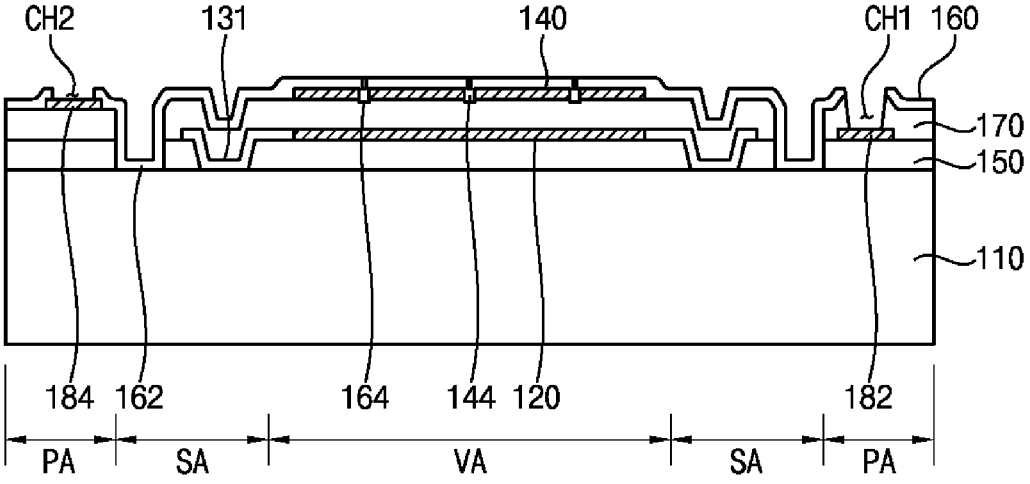

Referring to FIGS. 5, 12 and 13, an upper insulation layer 160 and a chamber portion 162 are formed on the sacrificial layer to cover the back plate 140 (S150).

At S150, forming the upper insulation layer 160 and the chamber portion 162 is performed, as will be explained in detail below.

As shown in FIG. 12, the sacrificial layer 170 and the lower insulation layer 150 are patterned to form a chamber hole 30 in the supporting area SA for forming a chamber portion 162. The substrate 110 may be partially exposed through the chamber hole 30. The chamber hole 30 may have a ring shape and may surround the second dam portions 138.

After forming an insulation layer 40 on the sacrificial layer 170 to cover a sidewall and a bottom of the chamber hole 30, the insulation layer 40 is patterned to form the upper insulation layer 160 and the chamber portion 162. Further, the dimples 164 may be further formed in the dimple holes 144, and a second contact hole CH2 is formed in the peripheral area PA to expose the back plate pad 184. Furthermore, portions of the insulation layer 140 and the sacrificial layer 170, which are positioned over the diaphragm pad 182, are etched to form a first contact hole CH1 in the peripheral area PA.

In an embodiment of the present invention, the insulation layer 40 may be formed of a material different from that of the lower insulation layer 150 and the sacrificial layer 170. For example, the insulation layer 40 is formed of silicon nitride, whereas the lower insulation layer 150 and the sacrificial layer 170 may be formed of silicon oxide.

Figure 14:
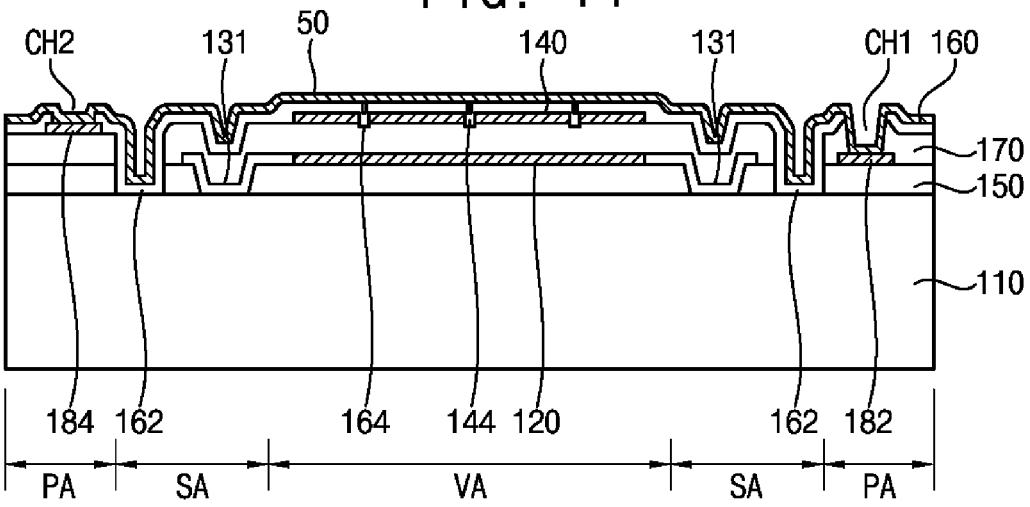
Figure 15:
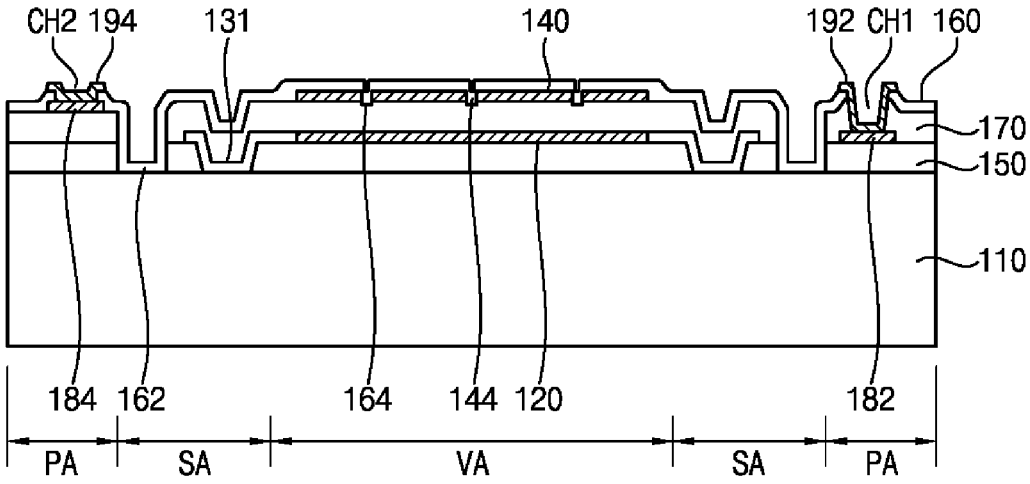

Referring to FIGS. 5, 14 and 15, after the first and second contact holes CH1 and CH2 are formed, first and second pad electrodes 192 and 194 are formed in the peripheral region PA (S160).

As shown in FIG. 14, a thin film 50 is formed on the upper insulation layer 160 on which the first and second contact holes CH1 and CH2 are formed. Here, the thin film 50 may be made of a conductive metal.

Next, as shown in FIG. 15, the thin film 50 is patterned to form the first and second pad electrodes 192 and 194.

Figure 16:
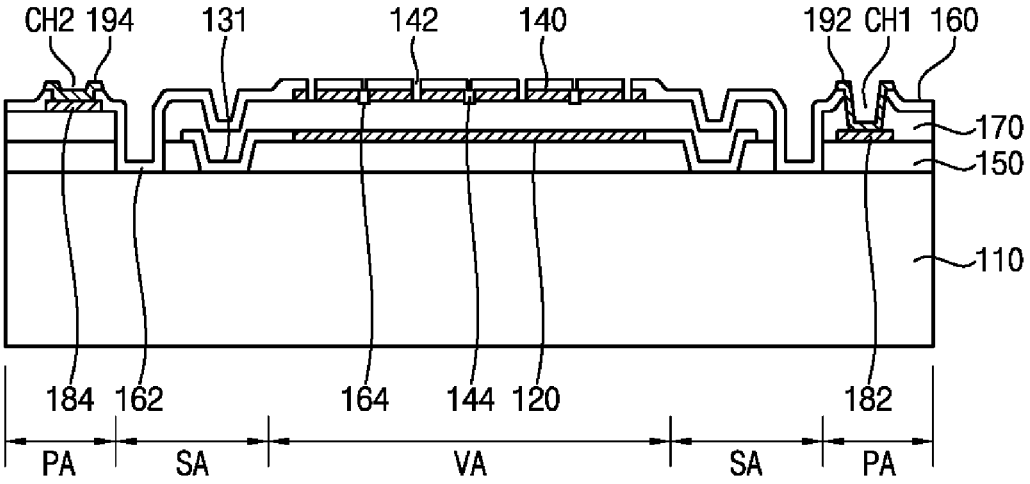

Referring to FIGS. 5 and 16, the upper insulation layer 160 and the back plate 140 are patterned to form acoustic holes 142 in the vibration region VA (S170).

Figure 17:
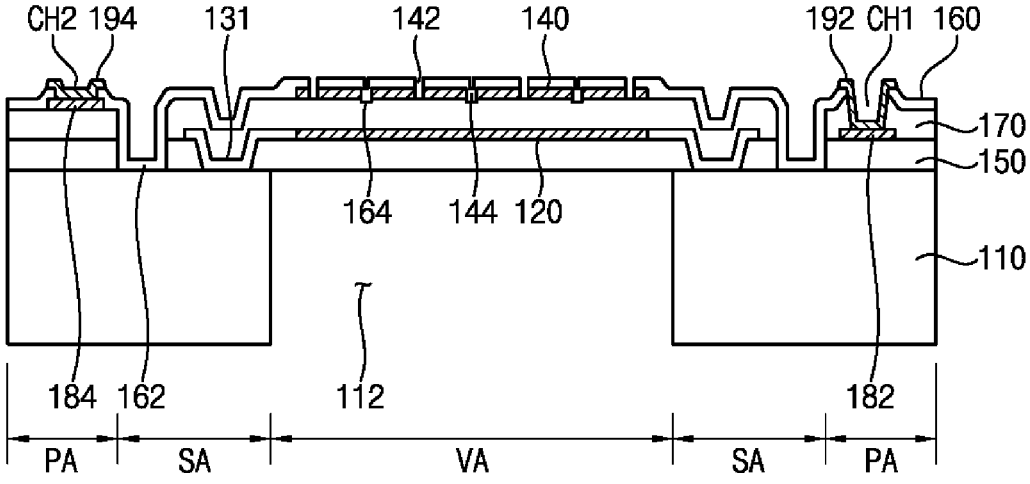

Referring to FIGS. 5 and 17, after forming the acoustic holes 142, the substrate 110 is patterned to form a cavity 112 in the vibration area VA (S180). The lower insulation layer 150 is partially exposed through the cavity 112.

The sacrificial layer 170 and the lower insulation layer 150 are partially etched through an etch process using the cavity 112 and the acoustic holes 142 (S190). As a result, the diaphragm 120 is exposed through the cavity 112, and an air gap AG between the diaphragm 120 and the back plate 140 is formed. Further, a portion of the lower insulation layer 150, located between the first and second dam portions 131 and 136, is removed to form a first slit portion 133 and a second slit portion 138 (see FIG. 1). Accordingly, as shown in FIGS. 1 and 2, the MEMS microphone 101 is manufactured. Here, the cavity 112 and the acoustic holes 142 may be provided as a pathway for the etchant for removing portions of the lower insulation layer 150 and the sacrificial layer 170.

Particularly, at S190, removing the sacrificial layer 170 and the lower insulation layer 150 from the vibration area VA and the supporting area SA, the first and second dam portions 131 and 136 and the chamber portion 162 may limit the movement of the etchant. Thus, an etch amount of the sacrificial layer 170 and the lower insulation layer 150 may be easily adjusted and a portion of the lower insulation layer 150, positioned inside the first and second dam portions 131 and 136, may be protected from remaining.

In an example embodiment of the present invention, HF vapor may be used as an etchant for removing the sacrificial layer 170 and the lower insulation layer 150.

As described above, the method of manufacturing the MEMS microphone may include forming the first dam portions 131 and the second dam portions 136 to extend along the circumference of the diaphragm 120 without any additional process.

Although the MEM microphone and the method of manufacturing the MEMS microphone have been described with reference to the specific embodiments, they are not limited thereto. Therefore, it will be readily understood by those skilled in the art that various modifications and changes can be made thereto without departing from the spirit and scope of the appended claims.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

The invention claimed is:

1. A MEMS microphone comprising:

a substrate having a cavity;

a back plate disposed over the substrate and having a plurality of acoustic holes;

a diaphragm disposed between the substrate and the back plate, the diaphragm spaced apart from the substrate and the back plate to form an air gap therebetween, and covering the cavity, the diaphragm being configured to sense an acoustic pressure to generate a displacement;

a first supporting member surrounding the diaphragm, the first supporting member including:

first dam portions arranged along a circumference of the diaphragm, and first slit portions between the first dam portions and adjacent thereto, the first slit portions configured to support the diaphragm from a lower face of the substrate; and a second supporting member surrounding the first supporting member, the second supporting member including:

second dam portions arranged along a circumference of the first dam portions, and second slit portions between the second dam portion adjacent to each other to be configured to further support the diaphragm from the lower face of the substrate.

2. The MEMS microphone of claim 1, wherein the first and the second supporting members are arcs that are arranged along a common circle.

3. The MEMS microphone of claim 1, wherein the first and the second slit portions are alternatively arranged.

4. The MEMS microphone of claim 1, wherein each of the first slit portions has a length smaller than that of each of the first dam portions.

5. The MEMS microphone of claim 1, wherein each of the second slit portions has a length smaller than that of each of second dam portions.

6. The MEMS microphone of claim 1, wherein each of the first dam portions has an arc shape in a plan view.

7. The MEMS microphone of claim 1, wherein each of the second dam portions has an arc shape in a plan view.

8. The MEMS microphone of claim 1, wherein each of the first dam portions has a "U" cross-sectional shape.

9. The MEMS microphone of claim 1, wherein each of the second dam portions has a "U" cross-sectional shape.

10. The MEMS microphone of claim 1, wherein the first and the second supporting members are integrally formed with the diaphragm.

11. The MEMS microphone of claim 1, further comprising:

an upper insulation layer disposed over the diaphragm and spaced apart from the diaphragm, the upper insulation layer being configured to hold the back plate; and a chamber portion positioned outside from the second supporting member, the chamber portion being connected to the upper insulation layer and making contact with the lower face of the substrate to support the upper insulation layer.

12. A method of manufacturing a MEMS microphone comprising:

forming a lower insulation layer on a substrate defining a vibration area, a supporting area surrounding the vibration area, and a peripheral area surrounding the supporting area;

forming a diaphragm and first and second dam portions of supporting the diaphragm on the lower insulation layer;

forming a sacrificial layer on the lower insulation layer to cover the diaphragm;

forming a back plate on the sacrificial layer and in the vibration area to face the diaphragm;

patterning the back plate to form a plurality of acoustic holes penetrating through the back plate;

patterning the substrate to form a cavity to partially expose the lower insulation layer in the vibration region; and performing an etch process using the cavity and the acoustic holes to remove portions of the lower insulation layer and the sacrificial layer in the vibration area and the supporting area, wherein performing the etch process using the cavity and the acoustic holes comprises:

forming first slit portions between the first dam portions adjacent to each other to form a first supporting member including the first dam portions and the first slit portions; and forming second slit portions between the second dam portions adjacent to one another to form a second supporting member including the second dam portions and the second slit portions.

13. The method of claim 12, wherein forming the diaphragm and the first and second dam portions comprises:

patterning the lower insulation layer to form a plurality of first dam holes spaced apart from each other and a plurality of second dam holes surrounding the first dam holes and being spaced from each other for forming the first and second dam portions;

forming a silicon layer on the lower insulation layer to cover the first and second dam holes; and patterning the silicon layer to form the diaphragm and the first and second dam portions.

14. The method of claim 12, wherein prior to forming the acoustic holes the method further comprises:

patterning the sacrificial layer and the lower insulation layer to form a chamber hole in the supporting area;

forming an insulation layer for holding the back plate on the sacrificial layer to cover the back plate and the chamber hole; and patterning the insulation layer to form the upper insulation layer for holding the back plate, and a chamber portion in the chamber hole, wherein forming the acoustic holes comprises patterning the back plate and the upper insulation layer to form the acoustic holes penetrating through the back plate and the upper insulation layer in the vibration region.

15. The method of claim 12, wherein the first and the second supporting members are arcs that are arranged along a common circle.

16. The method of claim 12, wherein the first and the second slit portions are alternatively arranged.

17. The method of claim 12, wherein each of the first slit portions has a length smaller than that of each of the first dam portions.

18. The method of claim 12, wherein each of the second slit portions has a length smaller than that of each of second dam portions.

* * * * *